US009153086B2

(12) United States Patent
Starke et al.

(10) Patent No.: US 9,153,086 B2
(45) Date of Patent: Oct. 6, 2015

(54) DEVICE FOR HANDLING COINS

(75) Inventors: Christian Starke, Paderborn (DE); Thorsten Neumann, Paderborn (DE)

(73) Assignee: Wincor Nixdorf International GmbH (DE)

( * ) Notice: Subject to any disclaimer, the term of this patent is extended or adjusted under 35 U.S.C. 154(b) by 78 days.

(21) Appl. No.: 13/571,421

(22) Filed: Aug. 10, 2012

(65) Prior Publication Data

US 2013/0199422 A1 Aug. 8, 2013

(30) Foreign Application Priority Data

Aug. 11, 2011 (DE) ..... 10 2011 052 575

(51) Int. Cl.
*G07F 9/10* (2006.01)
*G07D 3/00* (2006.01)
(Continued)

(52) U.S. Cl.
CPC .. *G07D 3/00* (2013.01); *E05G 1/02* (2013.01); *G07D 3/16* (2013.01); *G07D 9/008* (2013.01)

(58) Field of Classification Search
CPC ..... G07D 1/00; G07D 1/02; G07D 1/04; G07D 1/06; G07D 3/00; G07D 3/14; G07D 3/16; G07D 9/00; G07D 9/004; G07D 9/006; G07D 9/008; G07D 11/0081; G07D 13/00; G07D 2201/00; G07F 1/00; G07F 1/02; G07F 1/04; G07F 5/00; G07F 5/26; G07F 19/205; G07F 19/2055
USPC ..... 109/58, 58.5, 59 R, 60, 78–85; 902/8; 53/212, 532; 193/1, 2 R, 25 C, 30, 33, 193/34, 35 TE, DIG. 1; 194/215–217, 344, 194/350, 351; 453/1–3, 16–18
See application file for complete search history.

(56) References Cited

U.S. PATENT DOCUMENTS 4,883,183 A * 11/1989 Kimura et al. ..... 209/534
5,434,399 A * 7/1995 Barbe ..... 235/382
(Continued)

FOREIGN PATENT DOCUMENTS

WO 2005-073935 8/2005
WO 2005-104046 11/2005
(Continued)

OTHER PUBLICATIONS

German Search Report for Application No. 10 2011 052 575.0 mailed Feb. 27, 2012 (5 pages).

*Primary Examiner* — Jeffrey Shapiro
(74) *Attorney, Agent, or Firm* — Harness, Dickey & Pierce, P.L.C.

(57) ABSTRACT

The invention relates to a device (10) for handling coins comprising a first supply unit (26) at a first side (22) of the device (10) for the input of coins, at least one coin processing unit (30) for processing the coins supplied via the first supply unit (26), comprising a coin storage system (32) that comprises at least two coin storages (54 to 68) for storing coins, wherein the coin processing unit (30) sorts the supplied coins at least according to one sorting criterion in the coin storages (54 to 58), and comprising a dispensing unit (28) provided at the first side (22) for dispensing the coins removed from the coin storage system (32). At a second side (42) a second supply unit (50) for the input of coins is provided, wherein the coins input via the second supply unit (50) can be supplied to the coin processing unit (30).

15 Claims, 2 Drawing Sheets

(51) Int. Cl.

| | |
|---|---|
| ***E05G 1/02*** | (2006.01) |
| ***G07D 3/16*** | (2006.01) |
| ***G07D 9/00*** | (2006.01) |

(56) References Cited

U.S. PATENT DOCUMENTS

| | | | | |
|---|---|---|---|---|
| 6,092,629 | A * | 7/2000 | Bohnert et al. | 186/53 |
| 6,186,304 | B1 * | 2/2001 | Håkansson | 193/6 |
| 6,318,537 | B1 * | 11/2001 | Jones et al. | 194/346 |
| 6,637,576 | B1 * | 10/2003 | Jones et al. | 194/216 |
| 7,625,272 | B1 * | 12/2009 | Moreland et al. | 453/3 |
| 2001/0020638 | A1 * | 9/2001 | Uematsu et al. | 235/379 |
| 2003/0015397 | A1 * | 1/2003 | Coulter | 194/353 |
| 2003/0208970 | A1 * | 11/2003 | Saelzer | 52/167.1 |
| 2004/0173432 | A1 * | 9/2004 | Jones | 194/216 |
| 2004/0231956 | A1 * | 11/2004 | Adams et al. | 194/217 |
| 2004/0255354 | A1 * | 12/2004 | Graef et al. | 902/8 |
| 2005/0096986 | A1 * | 5/2005 | Taylor et al. | 705/16 |
| 2006/0065717 | A1 * | 3/2006 | Hurwitz et al. | 235/381 |
| 2006/0070843 | A1 * | 4/2006 | Zwieg et al. | 194/346 |
| 2006/0144670 | A1 * | 7/2006 | Gunst et al. | 194/320 |
| 2007/0034683 | A1 * | 2/2007 | Eastman et al. | 235/379 |
| 2007/0151827 | A1 * | 7/2007 | Brandstrom et al. | 194/206 |
| 2008/0073177 | A1 * | 3/2008 | Hansson | 194/344 |
| 2008/0135608 | A1 * | 6/2008 | Ireland et al. | 232/1 D |
| 2009/0047889 | A1 * | 2/2009 | Adams et al. | 453/5 |
| 2009/0118860 | A9 * | 5/2009 | Sjostrom | 700/231 |
| 2009/0236200 | A1 * | 9/2009 | Hallowell et al. | 194/215 |
| 2009/0307097 | A1 * | 12/2009 | De Faria | 705/17 |
| 2010/0017017 | A1 * | 1/2010 | Adams et al. | 700/223 |
| 2010/0210200 | A1 * | 8/2010 | Bell et al. | 453/3 |
| 2010/0242810 | A1 * | 9/2010 | Todd | 109/59 R |
| 2010/0307386 | A1 * | 12/2010 | Stockhausen et al. | 109/79 |
| 2011/0030312 | A1 * | 2/2011 | Wonka et al. | 53/167 |
| 2011/0281513 | A1 * | 11/2011 | Abe et al. | 453/3 |
| 2012/0012437 | A1 * | 1/2012 | Matsumoto | 194/342 |
| 2012/0042610 | A1 * | 2/2012 | Giovanetto et al. | 53/266.1 |
| 2013/0205723 | A1 * | 8/2013 | Blake et al. | 53/473 |

FOREIGN PATENT DOCUMENTS

| | | | | |
|---|---|---|---|---|
| WO | WO2009127731 | A1 * | 1/2009 | G07D 1/00 |
| WO | 2009-127731 | | 10/2009 | |

* cited by examiner

DEVICE FOR HANDLING COINS

BACKGROUND OF THE INVENTION

The invention relates to a device for handling coins. The coins supplied to the device via the supply unit are sorted in a coin processing unit, are stored in a coin storage system with at least two coin storages and can be dispensed at a dispensing unit. From document WO 2009/127731 A1 such a device is known.

In the retail sector it may, for example, be the case that due to change more coins are handed out to the customers than are earned. Alternatively or additionally it may be necessary that coin money not needed by a retail firm is collected. In both cases a retail firm depends on the supply of coin money or the disposal of coin money that is, for example, delivered or collected by a security transport company. Here, the personal handover of coins delivered or collected by the security transport company involves substantial time and effort, as the delivery of coins by the security transport company depends on the attendance time of the employees of the retail firm. Due to a necessary "second set of eyes principle" the handover of coin money to the security transport company is also associated with higher personnel expenses for the retail firm. Moreover, during the process of coins being supplied to the device by the security transport company it is not possible for the employees of the retail firm to supply coins what may lead to problems in the operating procedure. Supplying coins by an employee of the retail firm may be necessary if, for example, during a break or at change of shift a cashier supplies the coins from the cash drawer to the device.

SUMMARY OF THE INVENTION

Based on this prior art it is the object of the invention to specify a device for handling coins that enables a simply method for handing over coins.

In this device at a first side of the device a first supply unit for supplying coins is provided. Furthermore, the device comprises at least one coin processing unit for processing coins that are supplied via the first supply unit and a coin storage system that comprises at least two coin storages for storing coins. The coin processing unit sorts the supplied coins according to at least one sorting criterion in the coin storages. At the first side of the device there is a dispensing unit for dispensing the coins removed from the coin storage system. At a second side of the device there is a second supply unit for supplying coins. This second supply unit supplies the inserted coins to the coin processing unit.

This second supply unit for example is available exclusively to the security transport company, whereas the first supply unit is provided for the coins that are supplied to the device by employees of a retail firm or of a bank in which the device is installed. In this way nuisances for the employees of a retail firm or a bank during handover of coins to a security transport company are avoided.

Preferably, the first side and the second side of the device are arranged opposite to each other. Such an arrangement enables a large spatial separation of the supply units and avoids that, in case both supply units are used simultaneously, the users supplying coins to the device do not impede each other. Users are in particular employees of the retail firm, of the bank as well as employees of the security transport company. Further, this enables a spatial separation of the supply units, in particular if the device is integrated into a wall.

In a preferred embodiment the device has a control unit for determining the number of coins supplied to the respective coin storage. By this the inventory of each individual coin storage is known and retrievable any time. Thus, a user can verify if a service intervention is necessary due to a full or empty coin storage. Preferably an upper limit and/or a lower limit are set in a control unit of the device. When reaching and/or exceeding the upper limit the status of the coin storage is set to full and/or when reaching and/or falling below the lower value the status of the coin storage is set to empty. The value of the lower and/or the upper limit can also automatically depend on the amounts of coins and the coin requirements at the site of operation and/or on the operating time.

In an especially preferred embodiment the coin storage system comprises eight coin storages. By means of this, euro coins that are in circulation with eight different common coin values can be stored in a single denomination by assigning a coin storage to each coin value.

It is advantageous if the device comprises exactly one coin processing unit for processing the coins supplied via the first supply unit and the second supply unit. By this a compact design of the device is achieved. With the help of means that for example comprise a mechanical locking device it is guaranteed that only coins from the first supply unit or the second supply unit can be supplied simultaneously to the coin processing unit. This locking device for example prevents the access of a user to the supply unit to be locked or it can prevent the coin supply from the supply unit to the coin processing unit or it can delay the coin supply from the supply unit to the coin processing unit until the coin supply via the other supply unit is completed.

Preferably, the coin processing unit removes a predetermined number of coins from at least one coin storage. By simultaneously removing more than one coin the dispensing of coins at the dispensing unit is accelerated. In particular, a stack of coins with a predetermined height can be removed from below from a stack of coins arranged in one of the coin storages.

In a preferred embodiment the device is provided with means for authentication of a user. In particular these means can comprise a card reader, an RFID-reader or a scanner for determining biometrical data. Preferably before a transaction a user has to authenticate himself with the help of the means for authentication. By this the security can be increased as the device is operable by authorized users only.

In a preferred embodiment at least one control unit records the conducted transactions during which coins are supplied or removed. Thus, all changes in the amount of coins of the coin storages are documented. If in this recording at least the total value of the supplied or removed coins is recorded the security transport company can supply bulk coins to the device, that is to say a coin package of a random mixture of coins the value and denomination of which was determined by means of the device. As the provision costs for such packages of coins are lower than the provision costs for packages of coins of a single denomination with known coin number the costs for providing coins can be reduced.

Preferably to each recorded transaction a user is assigned who is authenticated for the respective transaction. By this it is achieved that an employee of the security transport company can supply coins to the device without being accompanied by another authenticated person, for example by a person authenticated by the retail firm or the bank as this transaction is recorded by means of the recording preferably in an audit-proof manner and can be verified subsequently, if necessary.

In an especially preferred embodiment the dispensing unit arranged at the first side is the first dispensing unit, and at the second side of the device a second dispensing unit is arranged. By means of the second output unit the coins removed from one of the coin storages by the coin processing unit can be dispensed at the second side of the device. Thus, coins cannot only be supplied at both sides but can also be removed at both sides. Consequently, two users can use the device simultaneously avoiding waiting time. Therefore, twice as many transactions can be conducted per time unit. Furthermore, this enables a spatial separation of the supply units, in particular if the device is integrated into a wall.

In a preferred embodiment the first dispensing unit transports the coins to be dispensed to at least one receiving compartment of a cash drawer arranged in the first dispensing unit and/or the second dispensing unit transports the coins to be dispensed to at least one receiving compartment of a cash drawer arranged in the second dispensing unit. This embodiment guarantees a quick and easy filling of the cash drawers required by the cashiers. Cash drawers are drawers of cash registers that are used for example in the retail business.

In an especially preferred embodiment the filling of the cash drawer is carried out with a predetermined number and denomination of coins that can be selected by the user and/or that is dependent on the cash drawer arranged in the first or second dispending unit. In this way the respective cash drawer is automatically filled with a mixture of coins that is optimal for the location depending on the cash drawer and/or a cashier assigned to one of the cash drawers.

Further, the first dispensing unit and/or the second dispending unit can transport the coins into pre-manufactured coin transport containers, for example in plastic bags or in bags. Afterwards, the respective dispensing unit can seal these coin transport containers, preferably in an audit-proof manner by heat sealing or gluing the openings. Afterwards, these sealed coin transport containers together with the coins in the coin transport container are dispensed by the respective dispensing unit. In this way packages of coins packed in an audit-proof manner are produced and dispensed.

It is especially preferable if a labeling unit for labeling the coin transport containers in the device is provided. The labeling of the coin transport containers can either be conducted by printing or sticking pre-printed labels on them. Alternatively or additionally, labels can be imprinted by means of the labeling unit and the imprinted labels can be stuck onto the coin transport container. Preferably the labeling of the coin transport container contains for example information with regard to content, value, number, destination and/or origin of the coins in the coin transport container. This information can be applied as clear text and/or in coded form, in particular as barcode.

In an especially preferred embodiment the device is arranged in a transfer safe. This transfer safe can preferably be integrated into a building wall. A transfer safe is accessible by a first and a second side, wherein the accessible sides are arranged such that after installation into a wall at each side of the wall there is one of both accessible sides.

For this purpose the device is arranged in the transfer safe such that the first side of the device with the first supply unit and the first dispensing unit is provided at the first accessible side of the transfer safe, and the second side of the device with the second supply unit and a possible second dispensing unit is provided at the second accessible side of the transfer safe. This embodiment enables the security transport company, independent of the service times of a company assigned to the transfer safe to supply this company with coin money and/or to dispose of coin money of this company.

In an especially preferred embodiment the coin processing unit comprises at least one sensor that detects at least one property of a supplied coin. The preferred properties are in particular the genuineness of the coin, the denomination of the coin, the currency of the coin and/or a picture of the obverse and/or the reverse of the coin. Alternatively or additionally by means of the sensor a geometric structure and/or a material property of the coin, such as a magnetic property of the coin, at least one dimension of the coin and/or the weight of the coin can be detected. In this way the coin can be identified clearly and/or the genuineness of the coin can be checked. Thus, a simple assignment of the coin storage for the respective coin is possible.

BRIEF DESCRIPTION OF THE DRAWINGS

Further features and advantages of the invention result from the following description which in connection with the enclosed Figures explains the invention in more detail with reference to embodiments.

DESCRIPTION OF THE PREFERRED EMBODIMENTS

Figure 1:
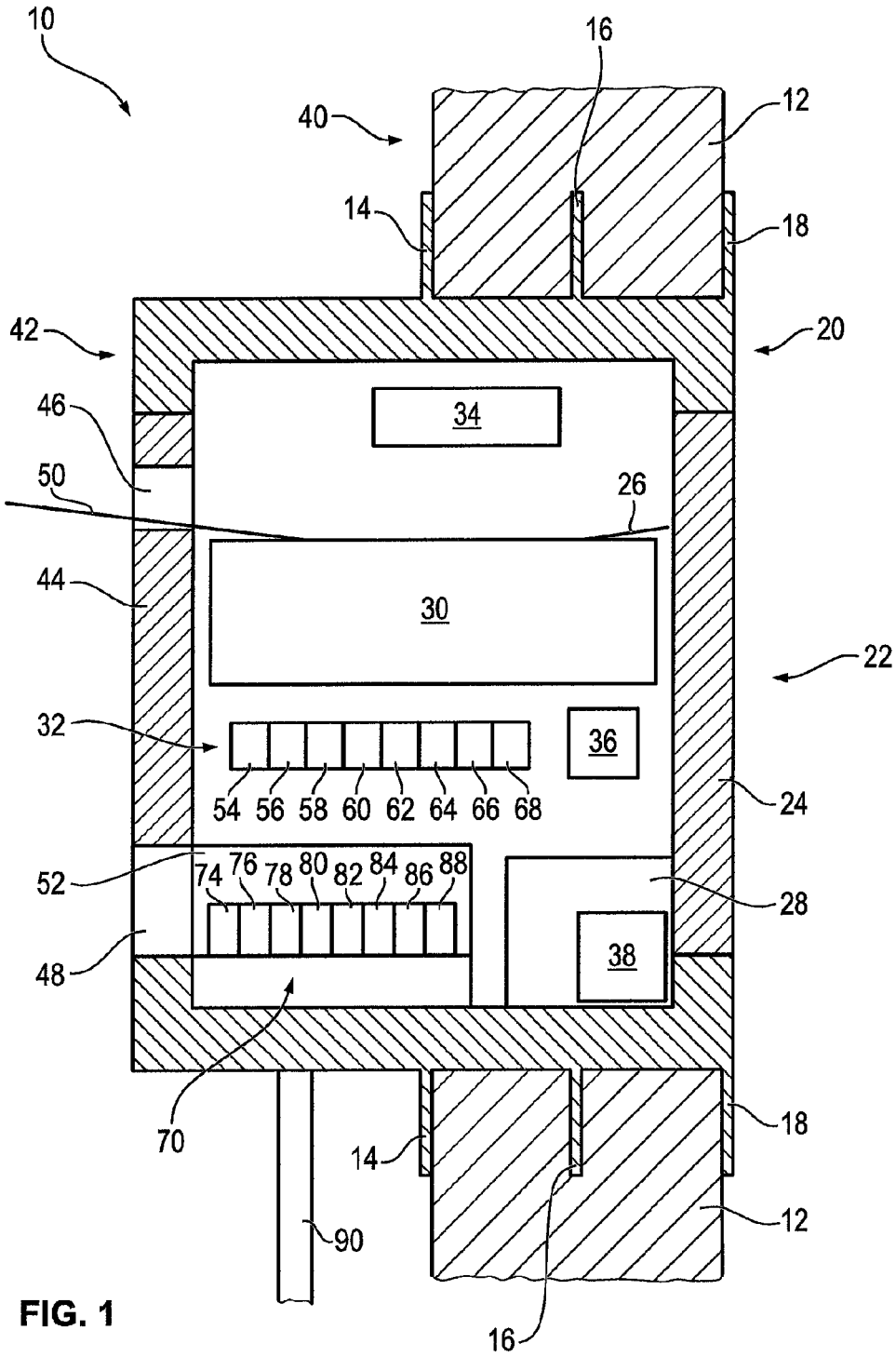
FIG. 1 is a cross-sectional schematic illustration of a device for handling coins with a cash drawer to be filled and a package of coins.

FIG. 1 shows a schematic illustration of the device 10 formed as transfer safe for handling coins with a cash drawer 70 to be filled. The device 10 is integrated into a building wall 12. The device 10 is provided with three circumferential locking elements 14, 16, 18 which at least make it difficult to remove the device 10 from the building wall 12. In alternative embodiments, additionally or alternatively to the three circumferential locking elements 14 to 18 different suitable mounting elements for mounting the device 10 in the building wall 12 can be provided.

At the outside 20 of the building wall 12 at its first side 22 the device 10 is provided with a first closed access 24. The first access 24 is designed as access door 24, so that when the first access door 24 is closed no access is possible to a first supply unit 26 located in the inside of the device 10 at the first side 22 and to a first dispensing unit 28 that is also located at the first side 22. Further, when the first access door 24 is closed, no access is possible to a coin processing unit 30 that is arranged in the inside of the device 10, to a coin storage system 32 arranged in the inside of the device 10, to a control unit 34 arranged in the inside of the device 10 and to a labeling unit 36 arranged in the inside of the device 10. A first package of coins 38 is also protected against access from the first side 22 by means of the access door 24.

At the inside 40 of the building wall 12 the device 10 protrudes from the building wall 12. A support device 90 is provided for supporting the part of the device 10 that protrudes from the building wall 12. At a second side 42 of the device 10 opposite to the first side 22 a second access door 44 illustrated in closed position in FIG. 1 is provided. This second access door 44 has a first opening 46 and a second opening 48. The first opening 46 enables coins (not illustrated) to be supplied to a second supply unit 50 when the second access door 44 is closed. The second opening 48 enables coins to be dispensed by a second dispensing unit 52 when the second access door 44 is closed. When the second access door 44 is closed the coin processing unit 30, the control unit 34, the labeling unit 36 and the coin storage system 32 are not accessible from the outside.

In the illustrated embodiment the coin storage system 32 comprises eight coin storages 54, 56, 58, 60, 62, 64, 66, 68. This embodiment is intended for use in a currency system with eight coins of different value in circulation, as is for example the case in the euro area. By means of this provided eight coin storages 54 to 68 that are able to store at least one coin, preferably to store each between two hundred and three hundred coins, these eight different coin values can be stored in the eight coin storages 54 to 68 by single denomination.

In this embodiment the first supply unit 26 is designed as a slide that is extendable in a telescope-like manner. By means of this the supply unit 26 can be brought in a first pushed together state or in a second extended state. The pushed together state is the deactivated state of the supply unit 26 and the extended state is the operating state for supplying coins.

FIG. 1 shows the first supply unit 26 in a pushed together state. In this pushed together state of the first supply unit 26 it is possible to lock the first access door 24. When the access door 24 is open the supply of coins via the first supply unit 26 is made difficult with regard to the operating state. The second supply unit 50 extends through the first opening 46 of the second access door 44 over the second side 42 of the device 10, enabling an easy supply of coins in this second supply unit 50. The second supply unit 50 can be removed for opening the second access door 44. In an alternative embodiment the second supply unit 50 is connected to the second access door 44 or in the same way as the first supply unit 26 it can be extended in a telescope-like manner from a pushed together state to an operating state. The second supply unit 50 is only then to be pushed together if the second access door 44 is to be opened or closed.

The first supply unit 26 and the second supply unit 50 are formed as slides and transport the coins supplied to them to the coin processing unit 30. The coin processing unit 30 checks by means of at least one sensor that is for example integrated into the coin processing unit 30 the genuineness of the coin and determines the value of the coin. According to this information the coin is sorted into the respective coin storage 54 to 68 that is provided for the coins of the determined monetary value. Coins that cannot be assigned to one of the coin storages 54 to 68 are supplied directly to one of both dispensing units 28, 52, wherein preferably a coin supplied via the first supply unit 26 is dispensed at the first dispensing unit 28 and a coin supplied to the second supply unit 50 is dispensed at the second dispensing unit 52. If in the respective dispensing unit 28, 52 there is a cash drawer 70, in a preferred embodiment of the device a coin that cannot be assigned to a coin storage 54 to 68 is dispensed next to the cash drawer 70.

In FIG. 1 the cash drawer 70 is arranged in the second dispensing unit 52. Access to this cash drawer 70 is possible through the second opening 48 in the second access door 44, even when the second access door 44 is closed. By means of a not-illustrated sensor or a not-illustrated input possibility for a user the coin processing unit 30 detects how many coins from each of the eight coin storages 54 to 68 of the coin storage system 32 are to be dispensed to the cash drawer 70. Alternatively, a standard predetermined number and denomination of coins can be dispensed. In this case from each coin storage 54 to 68 a different predetermined number of coins can be removed and be dispensed by means of the second dispensing unit 52 in a receiving compartment 74, 76, 78, 80, 82, 84, 86, 88 of the cash drawer 70 assigned to the respective coin storage 54 to 68.

Moreover, the device 10 comprises a control unit 34 that controls the operations in the device 10. Additionally, by detecting the number of coins supplied to or removed from one of the coin storages 54 to 68 the inventory of coins is determined, i.e. the number of coins in the respective coin storage 54 to 68. For this, either the coin processing unit 30 determines the required data and/or the device 10 is provided with not-illustrated sensors for determining the number of coins supplied to or removed from one of the coin storages 54 to 68 and makes these data available to the control unit 34.

Furthermore, the control unit 34 records at least transactions during which coins are supplied to or removed from the device 10 or the coin storage system 32, respectively. The recorded information can be stored in a storage unit in the device. Preferably, this control unit is a component of the control unit 34. On request of a user a recording with the logged information is printed out by means of the labeling unit 36 and is output by the first dispensing unit 28 or the second dispensing unit 52. Alternatively, the respective log data can be output via a data interface of the control unit 34 on request or in case of a new recorded event.

Figure 2:
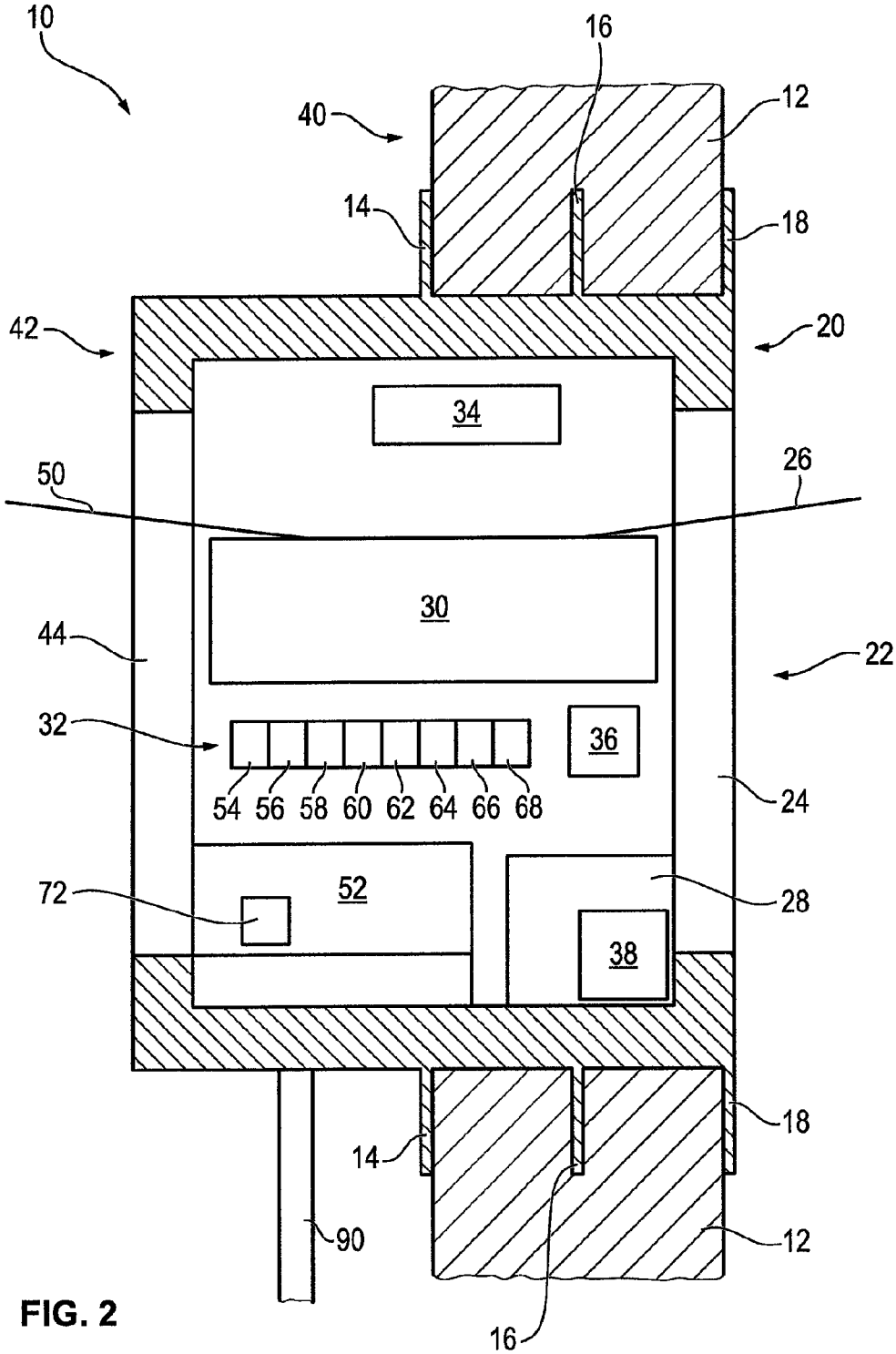
FIG. 2 is an illustration of the device according to FIG. 1 with two different packages of coins.

FIG. 2 shows the device according to FIG. 1 with opened access doors 24, 44 as well as without cash drawer 70. In addition to the first package 38 of coins a second package 72 of coins is shown.

In the opened state of the access doors 24, 44 shown in FIG. 2 access for operation is possible from the first side 22 and access for service is possible from the second side 42. During an operating access coins can be supplied to the device 10 via the first supply unit 26 or the second supply unit 50. Further, via the first dispensing unit 28 or the second dispensing unit 52 coins can be removed from the device 10 in form of packages of coins 38, 72 or by means of the cash drawer 70. During service operation further operations at the device 10 are possible that go beyond supplying and removing coins. Thus, during a service access a jam of coins can be removed or the components 30 to 36, 54 to 68 can be exchanged.

In FIG. 2 the coins are dispensed in form of coin packages 38, 72. The first coin package 38 differs from the second coin package 72 in that the second coin package 72 preferably comprises a predetermined number of coins of the same value, and for filling up one of the receiving compartments 74 to the cash drawer 70 illustrated in FIG. 1 is provided. The first coin package 38 comprises a multitude of coins of different values and is destined for being removed by the security transport company. The first coin package 38 is for example produced if one of the coin storages 54 to 68 has received a predetermined amount of coins. Then, a predetermined number of coins are removed from this coin storage 54 to 68 and preferably from further coin storages 54 to 68. All coins removed during this operation are collected in the first coin package 38.

For collecting the coins the first dispensing unit 28 and the second dispensing unit 52 are provided with pre-manufactured, empty containers for the transport of coins (not-illustrated). The respective dispensing unit 28, 52 fills the coins to be dispensed in these containers for the transport of coins, preferably in plastic bags or paper bags and seals the containers for the transport of coins, preferably by heat sealing or gluing in an audit-proof manner. A sealed container for the transport of coins that contains at least one coin is designated as coin package 38, 72. The labeling unit 36 labels the coin packages 38, 72 preferably at least with the coin value and a further designation that serves for identifying the coin package 38, 72 as first coin package 38 or as second coin package 72. Following this step the respective dispensing unit 28, 52 dispenses the coin package/s. The dispensing process at the first dispensing unit 28 can take place such that the first coin package 38 remains in the first dispensing unit 28 until the first access door 24 is opened.

In this specified embodiment the coin processing unit 30 is designed to process approximately ninety coins per minute, i.e. to supply coins to one of the coin storages 54 to 68 or to remove coins from one of the coin storages 54 to 68 and for example to dispense the coins in the receiving compartment 74 to 88 of the cash drawer 70 shown in FIG. 1 provided for the respective coin. Alternatively, the coins can be processed to a coin package 38, 72 by means of the respective dispensing unit and then these coin packages 38, 72 can be dispensed to the dispensing units 28, 52. The embodiment described in connection with the FIGS. 1 and 2 is however not restricted to a coin processing unit 30 with a processing capacity of approximately ninety coins per minute.

It is not necessary that at the first side 22 the first access door 24 or that at the second side 42 the second access door 44 is arranged. In alternative embodiments different access possibilities can be provided. In particular, at the first side 22 and the second side 42 similar access doors 24, 44 can be provided, so that the device 10 has two first access doors 24 or two second access doors 44.

The described embodiment of the first access door 24 prevents objects to be supplied to the device 10 which would impair an intended use of the device 10 or would require repair of the device.

In a further not-illustrated embodiment at the first side 22 and/or the second side 42 behind the first access door 24 there is a second access door 44. By means of this in-line arrangement of two access doors the advantages of both access doors are combined so that the device 10 is protected against supply of inappropriate objects by unauthorized persons and users can supply coins by means of the supply unit 26, 50 and/or can remove coins by means of the dispensing unit 28, 52. Here, the users do not have to be granted access to the coin processing unit 30, the coin storage system 32, the control unit 34 or the labeling unit 36. Service personnel with permission to open the second access door 44 is nevertheless granted access to the coin processing unit 30, the coin storage system 32, the control unit 34 or the labeling unit 36.

In a further embodiment the coin storage system 32 or the coin storages 54 to 68 determine the number of coins stored in the coin storages 54 to 68 and transfer these data to the control unit 34.

This application claims priority to German patent application No. 10 2011 052 575.0 filed Aug. 11, 2011 which is hereby incorporated by reference.

What is claimed is:

1. A device for handling coins, comprising:

a housing including a first door at a first side of the device and a second door at a second side of the device that is opposite to the first side, the first door is devoid of openings, the second door defines a first opening and a second opening therein, the housing is a transfer safe configured to be secured in a building wall with at least one locking element extending from an outer surface of the housing such that the first door is accessible at an outside side of the building wall and the second door is accessible at an inside side of the building wall;

at the first side of the device, a first supply unit for the input of coins, the first supply unit accessible at the first side of the device only when the first door is open;

at least one coin processing unit for processing the coins supplied via the first supply unit;

one coin storage system that comprises at least two coin storages for storing coins, the coin processing unit sorts the supplied coins at least according to one sorting criterion into the coin storages;

a first dispensing unit arranged at the first side for dispensing coins removed from the coin storage system, the first dispensing unit accessible at the first side of the device only when the first door is open;

at the second side is a second supply unit for the input of coins, the second supply unit configured to extend out from within the housing through the first opening defined in the second door, the coins input via the second supply unit can be passed through the first opening and supplied to the coin processing unit;

at the second side a second dispensing unit is arranged by means of which the coins removed from one of the coin storages by means of the coin processing unit can be dispensed at the second side of the device, the second dispensing unit accessible through the second opening when the second door is closed; and a control unit configured to dispense a plurality of coins of different and unsorted denominations at the first dispensing unit, and dispense at the second dispensing unit a predetermined number of coins of the same denomination.

2. The device according to claim 1 wherein the control unit captures the number of coins supplied to the respective coin storage.

3. The device according to claim 1 wherein the coin processing unit removes a predetermined number of coins from at least one of the coin storages.

4. The device according to claim 1 wherein the device is provided with means for authentication of a user, in particular a card reader, a RFID reader or a scanner for determining the biometrical data of a user.

5. The device according to claim 1 wherein the control unit records at least transactions made for supplying or removing coins.

6. The device according to claim 1 wherein the second dispensing unit transports the coins to a plurality of receiving compartments of a cash drawer arranged in the second dispensing unit, each one of the plurality of receiving compartments including coins of a single denomination.

7. The device according to claim 6 wherein the filling of the cash drawer is carried out according to a predetermined number and denomination of the coins that can be selected by the user and depends on the user and/or depends on the cash drawer.

8. The device according to claim 1 wherein the first dispensing unit and/or the second dispensing unit transports coins to prefabricated coin transport containers and closes these coin transport containers preferably in an audit-proof manner and dispenses these coin transport containers together with the coins included in the coin transport container.

9. The device according to claim 8, wherein a labeling unit for labeling the coin transport containers is provided.

10. The device according to claim 1 wherein the coin processing unit comprises at least one sensor that determines at least one characteristic of a supplied coin, in particular the genuineness of the coin, the denomination of the coin, the currency of the coin, a picture of the obverse and/or the reverse of the coin and/or a geometric structure and/or a material property of the coin, such as a magnetic property of the coin, an electrical property of the coin, at least one dimension of the coin and/or the weight of the coin.

11. A device for handling coins comprising:

a housing including a first door at a first side of the device and a second door at a second side of the device that is opposite to the first side, the first door is devoid of openings, the second door defines a first opening and a second opening therein, the housing is a transfer safe configured to be secured in a building wall with at least one locking element extending from an outer surface of the housing such that the first door is accessible at an outside side of the building wall and the second door is accessible at an inside side of the building wall;

a first supply unit at the first side of the device, the first supply unit configured to deposit coins into the device and accessible at the first side of the device only when the first door is open;

a second supply unit at the second side of the device that is opposite to the first side, the second supply unit configured to extend out from within the housing through the first opening defined in the second door to receive coins for deposit coins into the device;

a coin storage system including a plurality of coin storages each configured to store a plurality of coins therein;

a coin processing unit configured to sort coins from both the first supply unit and the second supply unit for depositing the coins into the plurality of coin storages;

a first dispensing unit at the first side of the device and accessible at the first side of the device only when the first door is open, the first dispensing unit configured to dispense coins at the first side;

a second dispensing unit at the second side of the device and accessible through the second opening when the second door is closed, the second dispensing unit configured to dispense coins removed from at least one of the plurality of coin storages at the second side; and a control unit configured to dispense a plurality of unsorted coins of different denominations into a single package of coins at the first dispensing unit, and dispense a plurality of coins at the second dispensing unit a drawer having a plurality of compartments such that each one of the plurality of compartments has coins of only the same denomination and the different ones of the plurality of compartments have coins of different denominations.

12. The device of claim 1, wherein the second dispensing unit is configured to dispense coins into a cash drawer seated within the second dispensing unit.

13. The device of claim 12, wherein the second dispensing unit is configured to dispense coins into a plurality of receiving compartments of the cash drawer such that each receiving compartment receives coins of the same denomination and different receiving compartments receive coins of different denominations.

14. A device for handling coins comprising:

a housing including a first door at a first side of the housing and a second door at a second side of the housing that is opposite to the first side, the second door defines both a first opening and a second opening therethrough;

a first supply unit at the first side of the housing, the first supply unit configured to deposit coins into the device, the first door is movable between a closed position in which the first door restricts access to the first supply unit and an open position in which the first door permits access to the first supply unit;

a second supply unit at the second side of the housing, the second supply unit configured to deposit coins into the device, the second supply unit is configured to extend through the first opening in the second door to accept coins for deposit;

a coin storage system including a plurality of coin storages each configured to store a plurality of coins therein;

a coin processing unit configured to sort coins from both the first supply unit and the second supply unit for depositing the coins into the plurality of coin storages;

a first dispensing unit at the first side of the housing, the first dispensing unit configured to dispense coins at the first side, the first door permits access to the first dispensing unit when in the open position and restricts access to the first dispensing unit when in the closed position;

a second dispensing unit at the second side of the housing, the second dispensing unit configured to dispense coins removed from at least one of the plurality of coin storages at the second side, the second opening in the second door is configured to permit access to the second dispensing unit when the second door is in a closed position;

a labeling unit configured to generate labels for packages dispensed from the device, the labels indicating value of coins in the packages; and a control unit configured to:

dispense a plurality of unsorted coins of different denominations into a single package of coins at the first dispensing unit;

dispense a plurality of coins of different and sorted denominations at the second dispensing unit into a drawer having different compartments such that each compartment has coins of the same denomination and the different compartments have coins of different denominations;

record and store information regarding transactions during which coins are deposited into and withdrawn from the device; and generate a transaction report using the labeling unit, the transaction report output at the first dispensing unit or the second dispensing unit.

15. The device of claim 14, further comprising a plurality of circumferential locking elements extending from an exterior of the housing configured to couple the housing to a wall such that the first side of the housing is on a first side of the wall and the second side of the housing is on a second side of the wall.

* * * * *